US010488102B2

(12) United States Patent
Baysal et al.

(10) Patent No.: US 10,488,102 B2
(45) Date of Patent: Nov. 26, 2019

(54) HOUSEHOLD COOLING APPLIANCE WITH AN ICE TRAY AND A COOLING DEVICE IN A DOOR

(71) Applicant: BSH HAUSGERAETE GMBH, Munich (DE)

(72) Inventors: Kudret Baysal, Giengen (DE); Carsten Weiss, Giengen (DE); Bernd Mettel, Herbrechtingen (DE); Axel Kluger, Giengen (DE); Johannes Schlosser, Unterschneidheim (DE); Markus Spielmannleitner, Ellwangen (DE); Michael Laudahn, Gundelfingen (DE)

(73) Assignee: BSH Hausgeraete GmbH, Munich (DE)

( * ) Notice: Subject to any disclaimer, the term of this patent is extended or adjusted under 35 U.S.C. 154(b) by 127 days.

(21) Appl. No.: 15/697,524

(22) Filed: Sep. 7, 2017

(65) Prior Publication Data

US 2019/0072317 A1 Mar. 7, 2019

(51) Int. Cl.

| | |
|---|---|
| ***F25B 21/02*** | (2006.01) |
| ***F25D 23/04*** | (2006.01) |
| ***F25C 5/20*** | (2018.01) |
| ***F25D 11/02*** | (2006.01) |
| *F25C 5/182* | (2018.01) |

(Continued)

(52) U.S. Cl.

CPC ..... *F25D 23/04* (2013.01); *F25C 5/22* (2018.01); *F25D 11/025* (2013.01); *F25B 21/02* (2013.01); *F25C 5/182* (2013.01); *F25C 2300/00* (2013.01); *F25C 2400/10* (2013.01); *F25D 17/065* (2013.01); *F25D 23/02* (2013.01); *F25D 2317/062* (2013.01); *F25D 2321/141* (2013.01)

(58) Field of Classification Search

CPC .... F25B 21/02; F25C 1/18; F25C 5/22; F25C 5/182; F25C 2300/00; F25C 2400/10; B67D 1/1236; F25D 23/006; F25D 21/04; F25D 23/04; F25D 17/065; F25D 2321/141

USPC ..... 62/3.63

See application file for complete search history.

(56) References Cited

U.S. PATENT DOCUMENTS

| | | | |
|---|---|---|---|
| 8,745,992 B2 | 6/2014 | Cheong et al. | |
| 2012/0023986 A1* | 2/2012 | Chae | F25D 21/04 62/132 |

(Continued)

FOREIGN PATENT DOCUMENTS

| | | |
|---|---|---|
| EP | 2444761 A2 | 4/2012 |
| WO | 2009017282 A1 | 2/2009 |

*Primary Examiner* — Davis D Hwu

(74) *Attorney, Agent, or Firm* — Laurence A. Greenberg; Werner H. Stemer; Ralph E. Locher

(57) ABSTRACT

A household cooling appliance has a housing with a receiving space for food, a door for closing the receiving space, wherein the door is movably arranged at the housing, an ice maker with an ice tray, wherein the ice maker with the ice tray is arranged in the door, a first cooling device, which is arranged at the door and by which the ice tray is cooled, wherein the first cooling device comprises a waste heat unit by which the waste heat resulting from the cooling of the ice tray can be dissipated, and a second cooling device, which is arranged at the housing and by which the receiving space is cooled. The waste heat unit of the first cooling device is thermally coupled with the second cooling device such that the waste heat of the waste heat unit can be transferred to the second cooling device.

4 Claims, 3 Drawing Sheets

(51) Int. Cl.
*F25D 17/06* (2006.01)
*F25D 23/02* (2006.01)

(56) References Cited

U.S. PATENT DOCUMENTS

| | | | | |
|---|---|---|---|---|
| 2013/0312872 | A1* | 11/2013 | Tobbe | B67D 1/1236 141/83 |
| 2016/0370050 | A1 | 12/2016 | Park | |
| 2016/0370060 | A1* | 12/2016 | Yang | F25D 23/006 |
| 2018/0156514 | A1* | 6/2018 | Wu | F25C 1/18 |

* cited by examiner

HOUSEHOLD COOLING APPLIANCE WITH AN ICE TRAY AND A COOLING DEVICE IN A DOOR

TECHNICAL FIELD

The invention relates to a household cooling appliance with a housing in which a receiving space for food is formed. The household cooling appliance also comprises a door for closing the receiving space, wherein the door is movably arranged at the housing.

BACKGROUND OF THE INVENTION

From the prior art there are known household cooling appliances where in a door of the household cooling appliance an ice maker is arranged. There, for cooling the ice maker, a Peltier element is present in the door which on the cold side is connected to the ice tray and on the warm side to another additional element. For heat dissipation, in the upper area the door comprises ventilation slots so that waste heat, conveyed by a fan, can be blown upwards out of the door. Such a design is, for example, known from EP 2 444 761 A2.

Furthermore, from US 2016 0370050 A1 and WO 2009 017282 A1 there is also known a household cooling appliance where an ice maker is arranged in the door. For cooling the ice maker, it is herein provided that a cooling circuit is arranged in the door.

With the known designs, waste heat removal is effortful and disadvantageous. For one thing, waste heat removal can be carried out only to a limited extent and, for another, the waste air is discharged out of the door itself directly to the outside and thus discharged in undesired exposed places.

SUMMARY OF THE INVENTION

It is the object of the present invention to provide a household cooling appliance where the cooling of an ice maker in the door can be performed more efficiently. It is a further object to provide a household cooling appliance where the waste heat resulting from the cooling of an ice tray in the door can be dissipated in an improved manner.

This object is solved by household cooling appliances according to the independent claims.

A first aspect of the invention relates to a household cooling appliance which comprises a housing with a receiving space for food. The household cooling appliance further comprises a door for closing the receiving space. The door is movably arranged at the housing. The household cooling appliance moreover comprises an ice maker which comprises an ice tray. The ice maker with the ice tray is arranged in the door. The household cooling appliance comprises a first cooling device which is arranged in the door and by which the ice tray is cooled. The first cooling device comprises a waste heat unit by which the waste heat resulting from the cooling of the ice tray can be dissipated. The household cooling appliance moreover comprises a second cooling device separate from the first cooling device, which is arranged in the housing. By the second cooling device the receiving space can be cooled. The waste heat unit of first cooling device is thermally coupled to the second cooling device such that the waste heat of the waste heat unit can be transferred to the second cooling device.

A further aspect of the invention relates to a household cooling appliance which comprises a housing with a receiving space for food. Besides, the household cooling appliance comprises a door for closing the receiving space. The door is movably arranged at the housing. The door moreover comprises a functional component which is at least in part an external component or visible component of the door. The household cooling appliance further comprises an ice maker with an ice tray, wherein the ice maker with the ice tray is arranged in the door. The household cooling appliance also comprises a first cooling device which is arranged in the door and by which the ice tray is cooled. The first cooling device comprises a waste heat unit by which the waste heat resulting from the cooling of the ice tray can be dissipated. The waste heat unit of the first cooling device is thermally coupled to the functional component such that the waste heat of the waste heat unit can be transferred to the functional component. In particular, the functional component is a component which at least partially constitutes an exterior component of the door and which is thus at least partially visible from the outside.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination but also in other combinations, without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the back-references of the claims.

BRIEF DESCRIPTION OF THE DRAWINGS

Embodiments of the invention are explained in the following in more detail on the basis of schematic drawings. These show in.

DETAILED DESCRIPTION OF PREFERRED EMBODIMENTS

Figure 1:
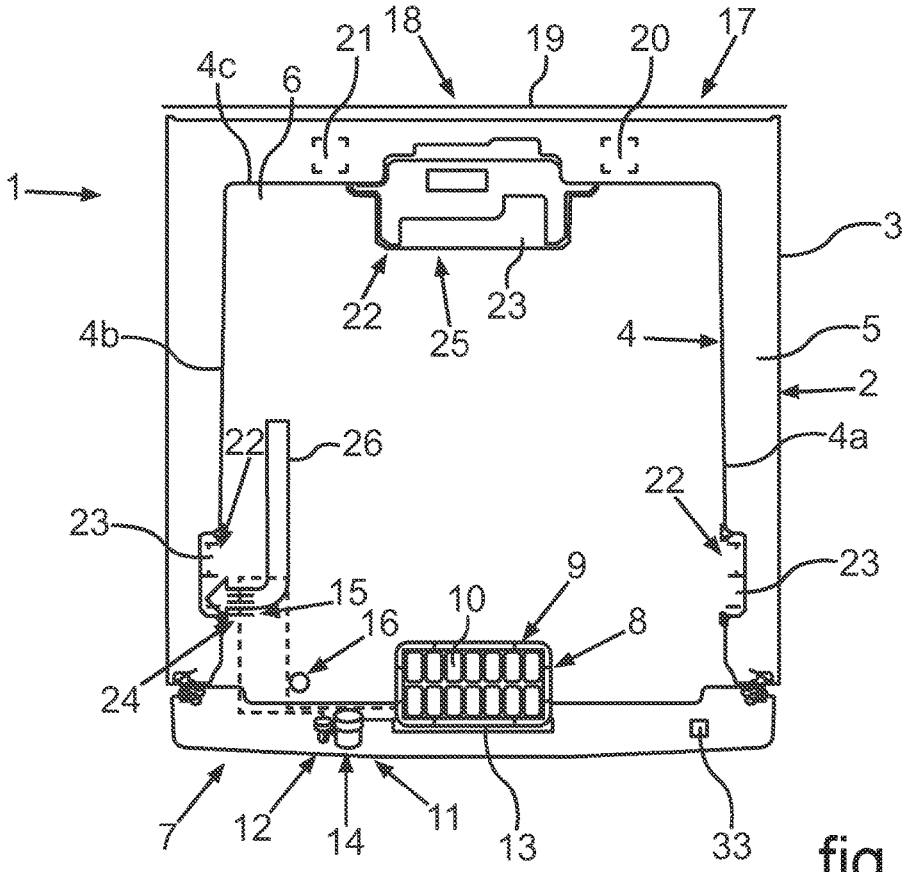
FIG. 1 a schematic horizontal sectional view of an embodiment of a household cooling appliance.

In the figures identical or functionally identical elements are equipped with the same reference signs.

With indications "top", "bottom", "front", "back", "horizontal", "vertical", "depth direction", "width direction", "height direction" etc. the positions and orientations given in the case of intended use and intended arrangement of the device are indicated.

In particular, the household cooling appliance is a no-frost household cooling appliance. A no-frost household cooling appliance is equipped with no-frost technology. By no-frost technology a technical method is understood in which air moisture in an interior space designed as a freezer is reduced. Thus, there is no or significantly less forming of frost on food and a defrosting of the freezer can be dispensed with or performed at noticeably larger intervals. With such no-frost technology cooling elements formed as cooling lamellas and thus a heat exchanger of the secondary cycle can, for example, be positioned in a separate area in the interior space. During the cooling phase the cold air is conveyed by a fan from the separate area into the interior space and thus the freezer. The design of these devices is such that air circulates through all the compartments of the interior space and in a cycle re-enters the separate area. Since cold air retains less moisture, this moisture primarily condenses and gathers as frost only on the heat exchanger of the secondary cycle, which is located in the separate area and which in the no-frost household cooling appliance is the coldest place which has contact with air. It can be provided that in specific intervals a defrosting mode is executed in which this first heat exchanger in the separate area is defrosted. For this purpose, specifically, in the no-frost household cooling appliance a heating device is provided by which the heating of the heat exchanger is performed. The water resulting from the melting of the ice layer can flow out of the interior and thus out of the device via a drainage channel and it can be collected in a collecting tray, which can also serve as an evaporation receptacle. In particular, in the defrosting mode the fan is deactivated such that the freezer remains cooled. Due to the no-frost technology, icing up of the cooling ribs is greatly reduced and there is a decrease of air moisture in the entire household cooling appliance, whereby the formation of ice layers is also greatly reduced.

By an exemplary, relatively simple method in a no-frost device air moisture in the freezer is significantly reduced. This is in particular achieved by separating the cooling lamellas from the actual cooling area or cooling compartment, wherein the cold air is conveyed into the freezer interior or freezer compartment by a fan. The cold air circulates in a cycle through all the compartments of the cooling device and re-enters the separate cooling area. Since it does not easily absorb or retain moisture, the moisture condenses on the cooling lamellas. The cooling lamellas are heated and defrosted in regular intervals and the water is preferably discharged into an evaporation receptacle, for instance via a channel. Air moisture decreases in the entire device and there is virtually no forming of ice layers. In contrast to conventional devices, in a household cooling appliance with no-frost technology the greater part of the occurring moisture that leads to icing over of conventional freezers collects in the separate area of the cooling lamellas.

FIG. 1 shows a horizontal sectional view of a household cooling appliance 1 which is configured for storing and preserving food. The household cooling appliance 1 can be a refrigerator or a freezer or a fridge freezer. The household cooling appliance 1 comprises a housing 2, which comprises an outer housing 3 and an inner container 4. In an intermediate space between the outer housing 3 and the inner container 4 there is arranged thermally insulating material 5. By walls of the inner container 4 at least one receiving space 6 for food is delimited. The receiving space 6 can be a cooling compartment or a freezer compartment. The household cooling appliance 1 can comprise at least two separate receiving spaces 6, for example a cooling compartment and a freezer compartment.

The household cooling appliance 1 further comprises a door 7, which is configured for closing the receiving space 6. The door 7 can be pivotably arranged at the housing 2. A pivoting axis can be oriented vertically to the plane of the figures.

The household cooling appliance 1 comprises an ice maker 8 which is configured to produce ice form elements from water or liquid. The ice maker 8 is arranged at or in the door 7. The ice maker 8 comprises an ice tray 9 in which cavities 10 are formed. The liquid can be inserted into the cavities 10 in order to freeze therein and produce the ice form elements. The ice tray 10 is likewise positioned at or, preferably, in the door 7. The representation of FIG. 1 is intended to be merely symbolic and exemplary without raising a claim to exhaustiveness as regards the position, size and orientation of the ice tray 9. Preferably, the ice tray 9 can thus also be entirely arranged within the door 7.

Besides, the household cooling appliance 1 comprises a first cooling device 11. The first cooling device 11 is presently also arranged in the door 7. By the first cooling device 11 the ice tray 9 can be cooled such that the liquid in the cavities 10 can freeze.

The first cooling device 11 can be a first cooling circuit 12. The first cooling circuit 12 preferably comprises an evaporator 13. The evaporator 13 is presently in direct contact with the ice tray 9 such that presently particularly advantageous thermal coupling for cooling the ice tray 9 is provided.

The first cooling device 11 moreover comprises a compressor 14. In addition, the first cooling circuit 12 comprises a condenser 15. The first cooling circuit 12 moreover comprises an expansion element 16 such as an expansion valve. A refrigerant circulates in the first cooling circuit 12.

It is specifically provided that the household cooling appliance 1 comprises a second cooling device 17. The second cooling device 17 is separate from the first cooling device 11. It is preferably provided that the second cooling device 17 is a second cooling circuit 18. The second cooling circuit 18 specifically comprises a condenser 19, a compressor 20 and an evaporator 21. By the second cooling device 17 the receiving space 6 is cooled.

It can be provided that the evaporator 21 is directly arranged in the receiving space 6.

In an advantageous embodiment it is provided that the household cooling appliance 1 is a no-frost household cooling appliance. In such an embodiment, the household cooling appliance 1 comprises a no-frost cooling aggregate 25 which comprises the second cooling device 17. Additionally, the no-frost cooling aggregate 25 comprises an air guidance system 22. The air guidance system 22 comprises at least one air duct 23 by which the cold air generated by the evaporator 21 is guided into the receiving space 6 and air from the receiving space 6 is again conveyed to the evaporator 21. In such an embodiment as a no-frost household cooling appliance the evaporator 21 is not arranged directly in the receiving space 6, but separate therefrom, and connected to the receiving space 6 via the air guidance system 22.

The first cooling device 11 comprises a waste heat unit 24, which can also be referred to as waste heat dissipation unit. The waste heat unit 24 is thermally coupled to the second cooling device 17 such that waste heat from the waste heat unit 24 can be transferred to the second cooling device 17. When the ice tray 9 is cooled, waste heat occurs in the first cooling device 11, which is dissipated. In the illustrated embodiment according to FIG. 1, the waste heat unit 24 is formed by the condenser 15 of the first cooling circuit 12. Thus, in this embodiment, the condenser 15 is thermally coupled to second cooling device 17. The waste heat is thus transferred to the second cooling device 17 via the condenser 15. The waste heat is then discharged into the environment of the household cooling appliance 1 via the second cooling device 17, in particular the condenser 19. Due to the removal of waste heat in such manner, the system can be rendered more efficient and a discharge of waste heat specifically out of the door, particularly in undesired places, can be avoided.

The household cooling appliance 1 can comprise a ventilator arranged such, that the air is directed to the waste heat unit 24. Therefore heat is transferred more effective.

In an alternative embodiment in which the household cooling appliance 1 is no no-frost household cooling appliance and thus does not comprise such an air guidance system 22, the waste heat unit 24 of the first cooling device 11 can also be directly thermally coupled with the evaporator 21 of the second cooling device 17. In such an embodiment, there is no no-frost aggregate 25. It is in particular envisaged that the first cooling device 11 is solely provided for cooling the ice maker 8 and thus the ice tray 9. Additional cooling of the receiving space 6 by the first cooling device 11 is presently not provided.

The dissipation of waste heat from the first cooling device 11 can in particular be effected via the evaporator 21 of the second cooling device 17. This is advantageous in that the overall system is merely required to operate against a comparatively small temperature range, which is e.g. between 15 K and 20 K. The discharge of the waste heat into the environment of the household cooling appliance 1 is effected by the more efficient second cooling device 17. Due to the above-mentioned advantageously small temperature range, the compact compressor 14 of the first cooling circuit 12 has significantly higher refrigerating capacity and efficiency than would be the case if it had to operate against the ambient temperature and thus in particular against the room temperature. This enhances the rate of ice production.

Specifically if the household cooling appliance 1 is designed as a no-frost household cooling appliance it is advantageous if the waste heat unit 24 is thermally coupled with an air flow 26 which is conveyed in the air guidance system 22 and thus also in the air duct 23. This means that the air flow 26 flows towards and particularly entirely around the waste heat unit 24 such that waste heat from the waste heat unit 24 is transferred to the air flow 26.

In the embodiment of FIG. 1, via the air ducts 23 preferably present and shown in the side walls 4*a* and 4*b* of the inner container 4, the air flow 26 is directed back from the receiving space 6 to the evaporator 21. Via the air duct 23 on the rear, which is thus formed at a rear wall 4*c*, the cold air is conducted into the receiving space 6.

Figure 2:
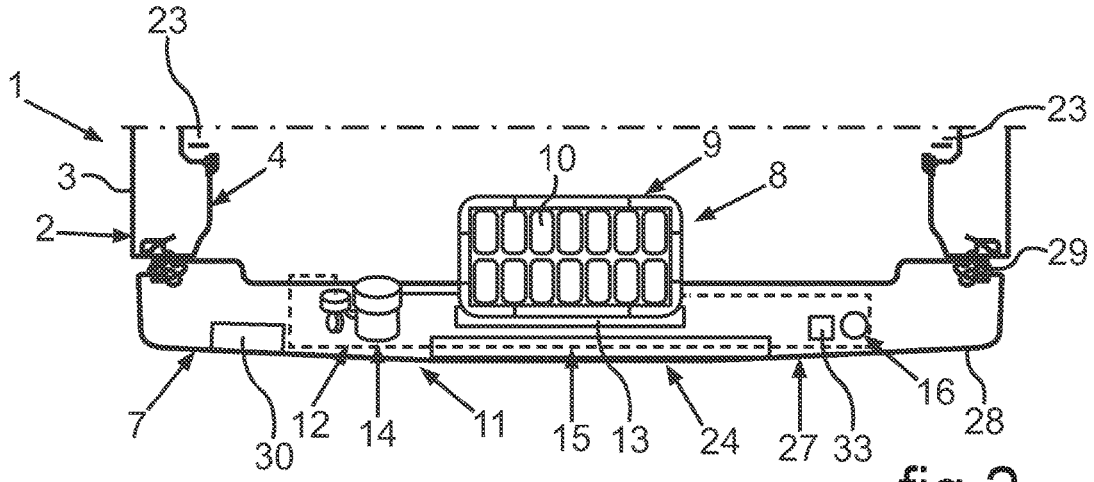
FIG. 2 an enlarged representation of a partial section of the household cooling appliance according to FIG. 1.

FIG. 2 shows partial elements of the household cooling appliance 1 in an embodiment which is different from that of FIG. 1. In contrast to the embodiments described in connection with FIG. 1, these can also be realized in the embodiment of FIG. 2. In contrast to the embodiments described in connection with FIG. 1, in the embodiments of FIG. 2 it is provided that the condenser 15 of the first cooling circuit 12 is a skin condenser. This skin condenser can be highly compact such that particularly also the volume of the door 7 can be maintained very low.

In this embodiment, the condenser 15 is again an embodiment for a waste heat unit 24. Due to the design of the condenser 15 as skin condenser, in this embodiment no direct thermal coupling with the evaporator 21 or the air flow 26 is provided, but instead thermal coupling with a functional component 27 of the door 7. Such a functional component 27 can, for example, be a front cover 28 of the door 7. In particular, such a component is referred to as functional component 27 of a door 7 which at least partially constitutes an exterior part of the door 7 and thus at least partially constitutes a visible component of the door 7. Waste heat dissipation is thus enabled in a particularly advantageous manner.

A further example of such a functional component 27 can be a door seal 29. It is also possible that such a functional component 27 is formed by a receiving shaft 30, which is configured to receive an electronic module and which in FIG. 2 is shown merely symbolically. The illustration of FIG. 2 is not meant to be exhaustive with regard to the size and position of the receiving shaft 30, but merely intended as a symbolic representation of such an embodiment of the functional component 27.

In an advantageous embodiment it is provided that due to the compact design of the first cooling device 11 the system with the first cooling device 11 and the ice maker 8 can in particular also be formed as an upgrade component for a household cooling appliance 1. Due to such a design it is thus enabled to upgrade a conventional household cooling appliance with such an ice maker 8.

Figure 3:
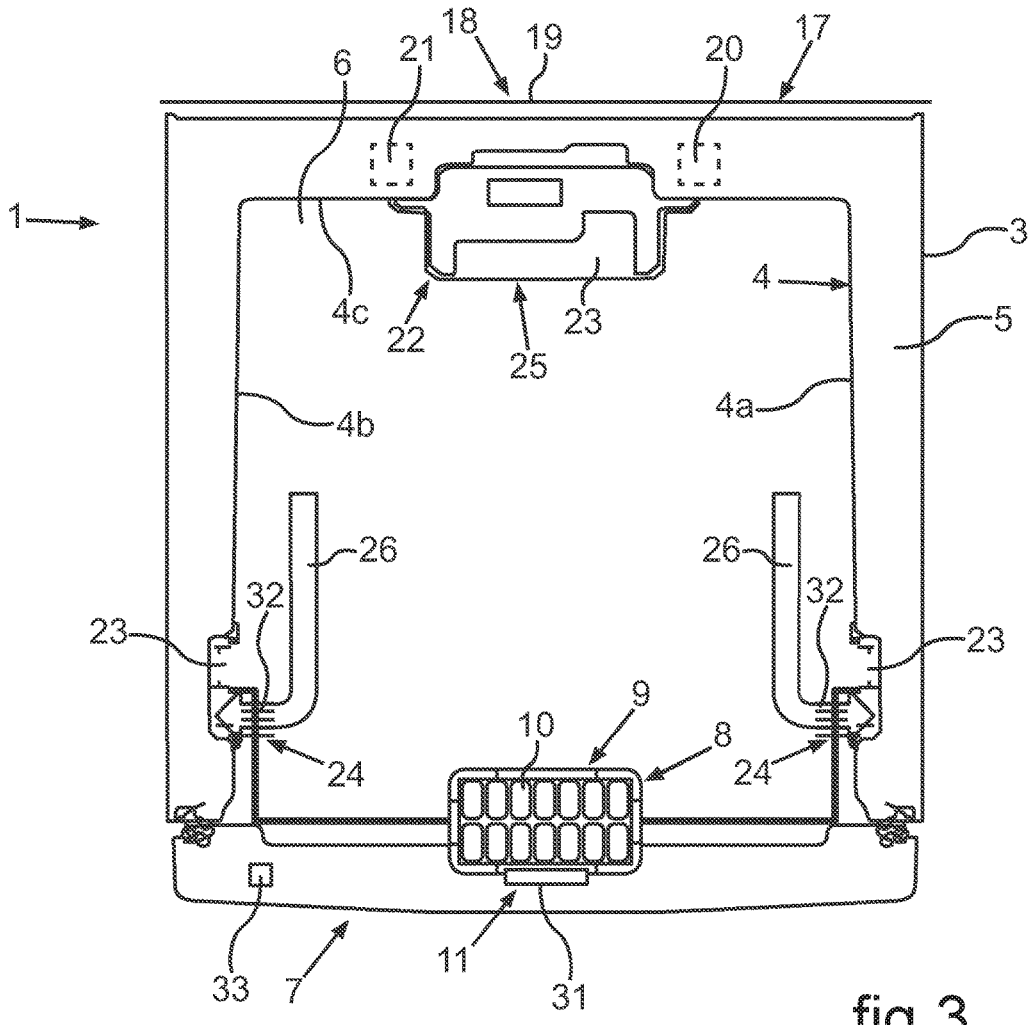
FIG. 3 a horizontal sectional view of a further embodiment of a household cooling appliance according to the invention.

FIG. 3 shows a further embodiment of the household cooling appliance 1 in a horizontal sectional view. In one embodiment, this household cooling appliance 1 can be formed as a no-frost household cooling appliance.

In contrast to the embodiments according to FIG. 1 and FIG. 2, it is presently envisaged that the first cooling device 11 is no cooling circuit as described in connection with FIG. 1 and FIG. 2, but that it comprises at least one Peltier element. With its cold side, the Peltier element, which is arranged in the door 7, is thermally coupled to the ice tray 9.

Further, the first cooling device 11 presently also comprises at least one waste heat unit 24, presently, by way of example, two waste heat units 24. In this embodiment, the waste heat unit 24 is formed as a heat pipe 32. The warm side of the Peltier element 31 is thermally coupled to the heat pipe 32. The heat pipe 32 is likewise arranged in the door 7. It is preferably provided that at least one heat pipe 32 comprises heat exchange lamellas which are in thermal contact with the warm side of the Peltier element 31.

Presently, in an alternative embodiment it can also be envisaged that a heat pipe 32 is directly thermally coupled with the evaporator 21. Such an embodiment is also advantageous in that the at least one Peltier element 31 merely has to operate against a comparatively small temperature range, which is presently, for instance, between 15 K and 20 K. The dissipation of the waste heat into the environment is presently also performed by the more efficient second cooling circuit 18.

In an embodiment in which the at least one heat pipe 32 is thermally coupled to the air flow 26 and thus at least contacted by the air flow 26 it is also possible to prevent undesired waste heat discharge into the receiving space 6 and to minimize the impact of waste heat dissipation into the receiving space 6 on the temperature stratification therein.

Figure 4:
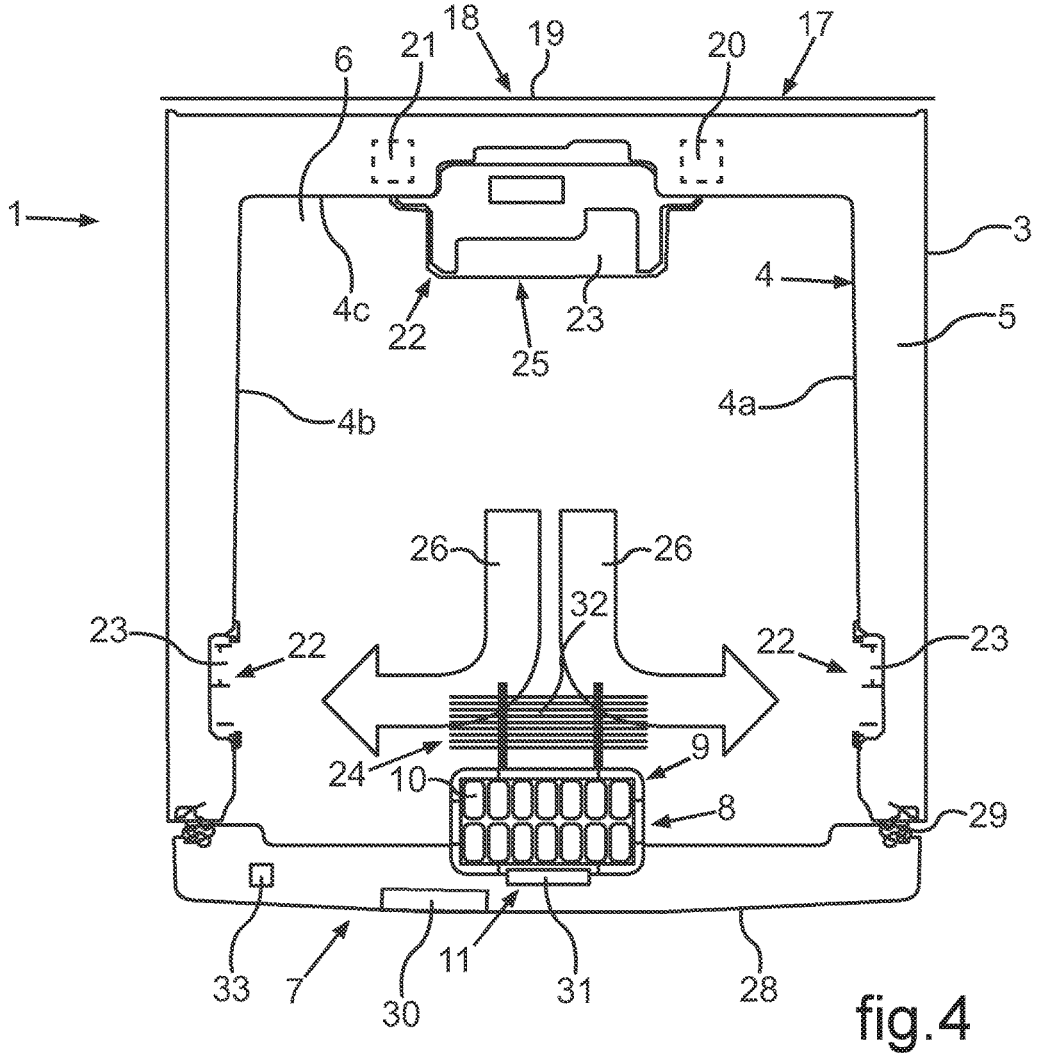
FIG. 4 a horizontal sectional view of a still further embodiment of a household cooling appliance according to the invention.

FIG. 4 shows a horizontal sectional view of the household cooling appliance 1 in an alternative embodiment to FIG. 3. Presently, in contrast to FIG. 3, at least one heat pipe 32 is arranged centrally and in close proximity to the ice tray 9.

In the embodiments according to FIG. 3 and FIG. 4, which comprise at least one Peltier element 31 and/or at least one heat pipe 32, the heat pipe 32 can also be thermally coupled with a functional component 27 specifically of the door 7. Presently, the functional component 27 can, for example, be a front cover 28, a door seal 29 or a receiving shaft 30 for an electronic module.

In an advantageous embodiment it can be provided that the Peltier element 31 additionally functions as a melting or thawing device. Thus, the ice form elements, which have been generated in the cavities 10, are easily subjected to incipient melting so that removing them from the ice tray 9 is rendered easier. For the purpose of such a functionality of the Peltier element 31 it can be provided that by a control unit 33, which can be arranged in the door 7 or else in the housing 3, the current direction is reversed for a specific length of time such that a warm side of the Peltier element 31 is thermally coupled with the ice tray 9. In other embodiments, a differently functioning heater can be provided for incipient melting of the ice form elements.

The control unit 33 can principally also be configured for controlling the ice maker and/or at least the first cooling device 11. It can also comprise further functionalities and control further components of the household cooling appliance 1. It can also, for example, control the electronic module which is arranged in a preferably present receiving shaft 30.

In these embodiments, the ice maker 8, particularly with the first cooling device 11, can be designed as an add-on system.

Generally, it can be provided that the first cooling device is a first cooling circuit which comprises an evaporator, a condenser and a compressor. Generally, it can also be provided that the waste heat unit of the cooling device is the condenser of the first cooling circuit. It can also generally be provided that the second cooling device is a second cooling circuit which comprises an evaporator, a condenser and a compressor. In particular, it is also generally possible that the waste heat unit is directly thermally coupled with the evaporator of the second cooling circuit.

In a further aspect it can generally be provided that the household cooling appliance comprises a no-frost aggregate which comprises the second cooling device and an air duct, wherein the evaporator of the second cooling device is arranged outside the receiving space. Cold air generated by the evaporator can be guided into the receiving space via the air duct. Air from the receiving space can be returned to the evaporator, wherein the waste heat unit of the first cooling device is contacted by the air flow guided in the air duct such that the waste heat is transferred from the waste heat unit to the air flow.

Besides, it can also generally be provided that the first cooling device comprises at least one Peltier element for cooling the ice tray.

In a further aspect it can generally be provided that the household cooling appliance comprises a control unit which is configured to control diverse components of the household cooling appliance. Therein, it can also be provided that the control unit is configured to control the Peltier element. In this context, the controlling can occur such that the Peltier element is operated reversely and the current direction is thus reversed. In an advantageous embodiment, the Peltier element can thus also be utilized as a melting unit or melting device for incipient melting of the ice form elements in the ice tray.

Generally, the waste heat unit can also comprise a heat pipe.

Generally, a functional component of a door can be a door seal or a receiving shaft for an electronic module or a front cover of the door. In particular, the functional component is at least partially an external component or visible component of the door.

LIST OF REFERENCE SIGNS

1 household cooling appliance
2 housing
3 outer housing
4 inner container
5 thermally insulating material
6 receiving space
7 door
8 ice maker
9 ice tray
10 cavities
11 first cooling device
12 first cooling circuit
13 evaporator
14 compressor
15 condenser
16 expansion element
17 second cooling device
18 second cooling circuit
19 condenser
20 compressor
21 evaporator
22 air guidance system
23 air duct
24 waste heat unit
25 no-frost aggregate
26 air flow
27 functional component
28 front cover
29 door seal
30 receiving shaft
31 Peltier element
32 heat pipe
33 control unit

The invention claimed is:

1. A household cooling appliance, comprising
a housing with a receiving space for food,
a door for closing the receiving space, the door being movably arranged at the housing,
the door including a functional component, and the functional component being at least partially an outer component of the door, the functional component being a front cover of the door,
an ice maker with an ice tray, the ice maker with the ice tray being arranged at the door,
a first cooling device, being arranged at the door and by which cooling the ice tray,
the first cooling device including a waste heat unit dissipating the waste heat resulting from the cooling of the ice tray, the waste heat unit being a condenser, and
the condenser being thermally coupled with the functional component for transferring the waste heat to the front cover.

2. The household cooling appliance according to claim 1, wherein the functional component includes a door seal.

3. The household cooling appliance according to claim 1, wherein the functional component includes a receiving space for an electronic module.

4. The household cooling appliance according to claim 1, wherein the condenser is a skin condenser.

* * * * *